United States Patent [19]

Sanderson

[11] 4,353,193

[45] Oct. 12, 1982

[54] CHANGEABLE WALL PANEL STRUCTURE

[76] Inventor: Dewey S. C. Sanderson, 3901 E. 26th Ave., Denver, Colo. 80205

[21] Appl. No.: 175,019

[22] Filed: Aug. 4, 1980

Related U.S. Application Data

[63] Continuation-in-part of Ser. No. 57,446, Jul. 13, 1979, abandoned.

[51] Int. Cl.[3] ..... B44F 7/00

[52] U.S. Cl. ..... 52/311; 52/476

[58] Field of Search ..... 52/311, 476; 160/201; 312/257 A

[56] References Cited

U.S. PATENT DOCUMENTS

| | | | |
|---|---|---|---|
| 3,169,281 | 2/1965 | Clements, Jr. | 52/476 |
| 3,178,776 | 4/1965 | Stansberry | 160/201 X |
| 3,299,594 | 1/1967 | Kellert | 52/476 X |
| 3,440,786 | 4/1969 | Weaver | 52/311 |
| 3,643,395 | 2/1972 | Schuyler et al. | 52/509 |
| 3,744,199 | 7/1973 | Navarre | 52/241 X |
| 4,158,277 | 6/1979 | Krempp et al. | 312/204 X |

*Primary Examiner*—Price C. Faw, Jr.
*Assistant Examiner*—Carl D. Friedman
*Attorney, Agent, or Firm*—McDougall, Hersh & Scott

[57] ABSTRACT

A wall-mounted structure includes a support which removably holds an inner decorative panel having displays on opposite sides. The inner panel is secured to the support by a mounting means which permits the reversal of the panel to expose either side. A frame is provided with a second mounting means to hold a series of outer decorative panels which can partially or totally conceal the inner panel from view. Each decorative panel is changeable and reversible.

7 Claims, 9 Drawing Figures

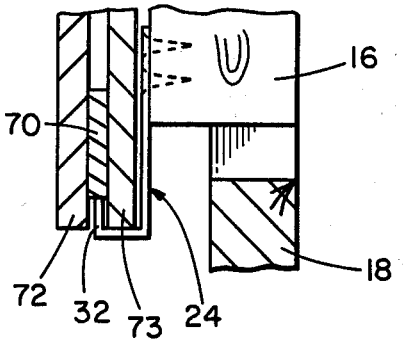
FIG. 8
FIG. 9
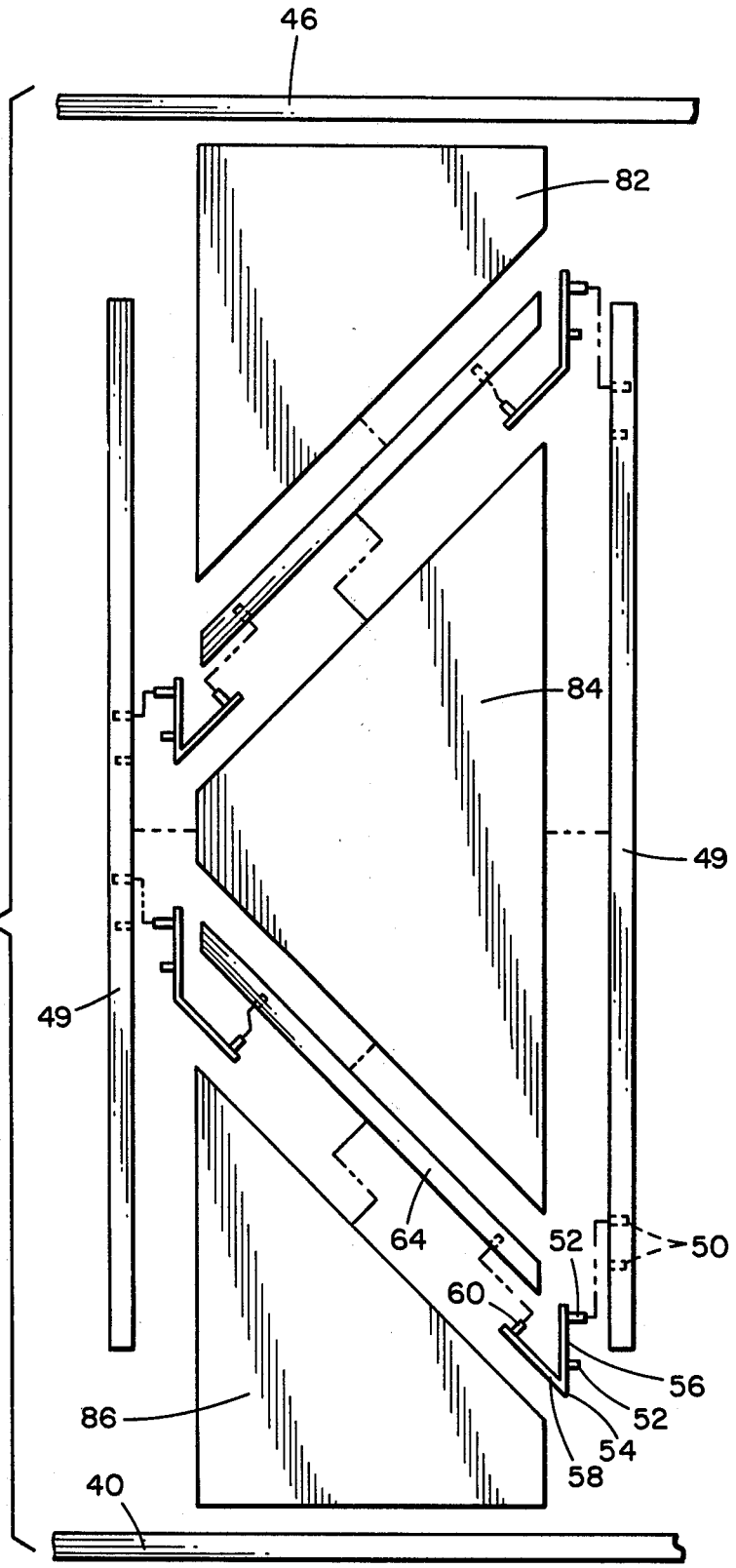

CHANGEABLE WALL PANEL STRUCTURE

CROSS REFERENCE TO RELATED APPLICATION

This application is a continuation-in-part of application Ser. No. 57,446, filed July 13, 1979, now abandoned, entitled "Changeable Wall Structures".

BACKGROUND OF THE INVENTION

The present invention relates generally to an improved wall covering and, specifically, to a wall structure for supporting both inner and outer decorative panels to provide a versatile system for interior design. The panels are changeable and can be reversed easily to display a second surface with an alternate color or design.

Conventional wall covering materials, such as paint, tile, wallpaper and paneling, are relatively permanent once applied and, depending on the material selected, can require considerable time and expense to replace. As a result, a consumer usually selects a durable, easy to clean wall covering to maximize useful life and to minimize the need for redecorating.

The invention of the parent application, as referred to above, is a versatile substitute for standard painted, tiled, papered or paneled walls. The appearance of any wall can be easily and quickly improved through the use of changeable panels. Two decorative panel surfaces can be joined to form a single reversible panel, or a single panel can be used with a different or similar covering laminated on each side. Use of this dual purpose panel reduces the need for additional space to store replacement displays.

The present invention further increases the versatility of a wall display unit. Outer panels of various lengths and shapes can be mounted within a frame positioned over an inner decorative panel to subdivide a vertical wall space. The removal of an outer panel exposes the inner decorative panel to view. In this manner, the design possibilities and color combinations of the wall display structure are greatly increased.

SUMMARY OF THE INVENTION

The present invention provides a wall-mounted display structure to substitute for conventional wall coverings. The construction of the invention is highly versatile, and the appearance of a wall can be easily and quickly changed. In addition, the wall displays can be replaced inexpensively once the framework of the invention has been installed as a partition or on a wall.

Specifically, the invention comprises a support which can be attached to a wall or which can form an integral part of a wall. As will be more fully appreciated upon consideration of the following disclosure, the term "support" is to be broadly construed and can be part of an existing wall, such as a plastered or paneled surface, studding, concrete or any other means capable of support. A mounting means which can include a latch and a bracket holds an inner decorative panel securely on the support while, at the same time, providing a mechanism for quick release when changing the panel.

A series of outer panels is held by a second mounting means in a frame over the decorative panel and the support to partially or totally conceal the inner panel from view. The series of outer panels can be secured within the frame in a tiered relationship with one panel above. another. This construction greatly enhances the design capabilities of the structure and is a versatile aid in interior design.

BRIEF DESCRIPTION OF THE DRAWINGS

FIG. 8 is an enlarged cross-sectional view taken about the line 8—8 of FIG. 6; and FIG. 9 is a front elevational view illustrating an alternative tiered arrangement of trapezoidal outer panels.

DETAILED DESCRIPTION

Figure 1:
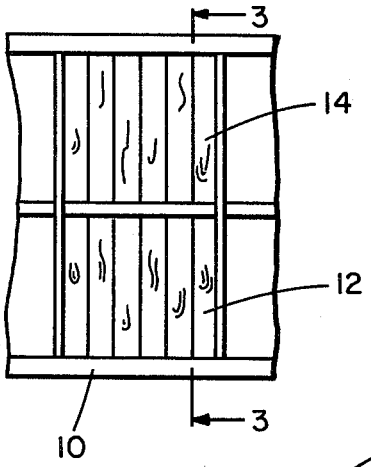
FIG. 1 is a fragmentary view of a wall illustrating the display structure of the invention.

FIG. 1 is a perspective view of a wall having, as an integral part, the display structure of this invention. The structure comprises a frame 10 with a bottom and top display panel 12 and 14, respectively, removably mounted within the frame in a tiered relationship. Frames can be positioned to extend along the width of a wall in a side-by-side configuration. In addition, the frames can be mounted to cover less than the entire wall surface in either a lateral or vertical sense.

Figure 2:
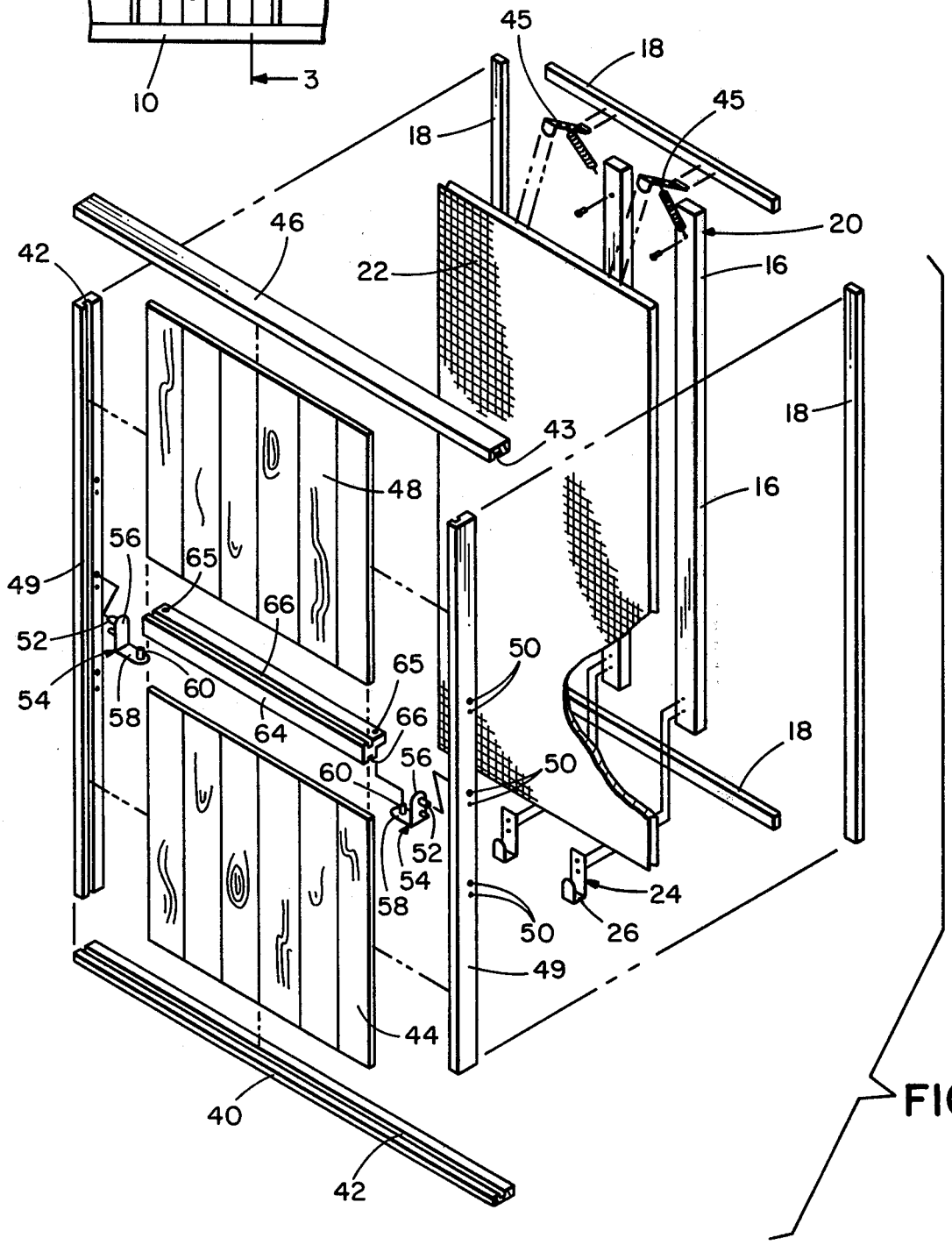
FIG. 2 is an exploded perspective view of the invention.

FIG. 2 is an exploded view which illustrates the unassembled components of the subject wall covering structure. Studs 16 and border members 18 are immovably connected to a wall to form a support 20 for the wall display structure. Each stud 16 can comprise a single member extending between the top and bottom border members 18. Alternatively, the stud 16 can include just a top and bottom piece 19 and 21, respectively, to reduce material costs. (See FIG. 6). The border members 18 define a perimeter to which the frame 10 can be attached.

The support 20 can alternatively be part of an existing wall. A plastered, paneled or concrete surface, for example, can function to support the wall display. The support can also comprise the frame of a second wall display unit; two frames can be connected back-to-back such that each serves as a support for the other. In this manner, the joined frames can comprise a room partition having reversible, changeable panels visible from both sides of the structure.

Figure 5:
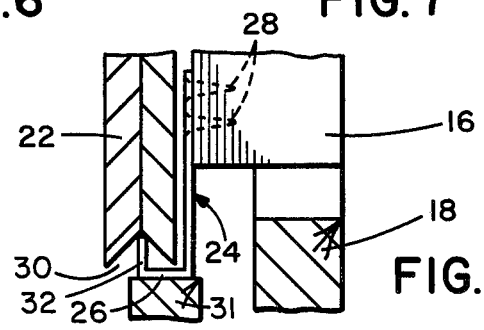
FIG. 5 is an enlarged cross-sectional view taken about the line 5—5 of FIG. 2.

An inner decorative panel 22 is mounted on the support 20 by an angle bracket 24 having a channel portion 26; the bracket is secured to a given stud 16 by fasteners 28. (See FIG. 5). To further support the angle bracket 24, a small block of wood 31 can be placed between the bracket and the bottom frame section 40. (See FIG. 3). The channel portion 26 receives the lower edge of the inner panel. More specifically, recesses 30 are formed in the bottom edge of the panel in a spaced relationship. Alternatively, the recess 30 can extend along the entire length of the bottom edge of the panel 22. A flange 32 of the bracket is adapted to receive the recess 30.

The inner decorative panel 22 comprises a pair of wooden sheets which have a texture of the kind frequently used for wood paneling. Each sheet can be made from a different variety of wood so that upon lamination of the sheets the opposite sides of the panel 22 expose a different surface. Thus, an alternate wood paneling appearance can be accomplished by releasing the panel and placing the bottom edge of the panel on the flange 32 and in the channel portion 26 of the angle bracket 24.

The decorative panel could be constructed of other materials; for example, the use of plastic would permit the molding of a wide variety of surface appearances. In addition, drywall or the like could be used. Metal eyelets (not shown) can be inserted in the drywall to receive hooks or screws which are fastened to the support 20 for hanging objects such as paintings without damaging the drywall.

Coverings for the decorative panel are also contemplated. Wall paper or a similar material can provide one means for achieving a different surface on the panel. Cloth or vinyl coverings with various designs and textures, as well as leather, could be attached. In such cases, the coverings could be replaced particularly if magnetic strips, velcro, elastic straps or other attaching means are used to make the coverings easily removable.

Figure 4:
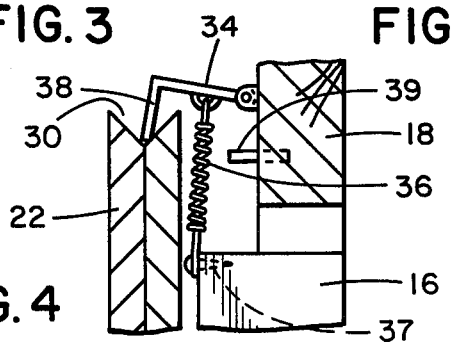
FIG. 4 is an enlarged cross-sectional view taken about the line 4—4 of FIG. 2.

As illustrated in FIG. 4, the top edge of the inner decorative panel 22 also contains a recess 30. A latch 34 is pivotally connected to the upper border member 18. A spring 36 is connected to the stud 16 by a fastener 37 and extends between the stud and the latch. A peg 39 is connected to the upper border member 18 to limit the downward movement of the latch 34 when the panel 22 is removed. A screw nail or the like could function as the peg 39. The latch includes an engaging end 38 adapted to be received in the recess 30 defined by the top edge of the panel 22.

When installing the inner decorative panel 22, the panel is lifted and the top edge of the panel is placed under the engaging end 38 of latch 34 to permit the upper recess 30 to receive the engaging end 38. (See FIG. 3). The bottom edge of the decorative panel is then swung inwardly and lowered to permit the lower recess 30 to engage the flange 32 and channel portion 26 of each angle bracket 24. The procedure is reversed to remove the panel. The spring action serves to hold the decorative panel in place; however, the panel can be readily swung away from the support 20 despite the spring tension to change or reverse the panel. In addition, the spring tension can be adjusted by providing holes 45 in the latch 34 for releasably receiving the upper end of the spring 36. (See FIG. 2).

Referring again to FIGS. 2 and 3, the bottom section 40 of the frame 10 includes a channel 42 which receives the lower edge of a bottom outer panel 44. Similarly, the top section 46 of the frame includes a deeper channel 43 which receives the upper edge of a top outer panel 48. Channels 42 are also provided in the side frame sections 49 to hold the panels in a secure relationship within the frame.

The side frame sections 49 include holes 50 which receive extensions 52 of a support brace 54. The support brace comprises a first plate 56 and a second plate 58 connected substantially perpendicular to the first plate. The extensions 52 are attached to the first plate 56 and upon engaging the appropriate holes 50 in the side frame section secure the brace in position. The second plate 58 has a similar extension 60 which engages a hole 62 in a shelf 64.

Upon positioning a brace 54 on each inside surface of two adjacent side frame sections, as illustrated in FIG. 2, a hole 65 at each end of the shelf can engage the correcponding extension 60 of the brace 54 to support the shelf and to subdivide a vertical wall space.

The support braces can be positioned at any point along the inside face of the side frame sections. In this manner, the area within the frame is partitioned into any number of openings for the insertion of outer panels.

As illustrated, both the top and bottom surfaces of the shelf 64 include a groove 66 for the insertion of a panel edge. In use, the lower and side edges of the lower panel 44 are first inserted into the channels 42 of bottom and side frame sections 40 and 49, respectively. Braces 54 are then connected to the side frame sections, as previously described, and the shelf 64 is attached to the braces so that the lower groove 66 of the shelf receives the top edge of the lower panel 44.

The upper edge of the top panel 48 is then inserted into the channel 43 of the top frame section 46 . The top panel is swung inwardly to permit the lower edge of the panel to be received by the groove 66 of the shelf 64. It should be noted that the channel 43 of the top frame section is deeper than the channel 42 of the bottom frame section 40. The increased depth of the top channel enables the top panel 48 to swing clear of the upper surface of the shelf 64 upon insertion of the panel, and also permits the panel 48 to be removed easily by raising and swinging outwardly the shelf 64. It should also be noted that the lower groove 66 of shelf 64 is less deep than the channel 43 of top frame section 46. This facilitates the elevation and removal of panel 48. To further aid in removing the top panel 48, knobs 67 or the like can be secured to the panel to serve as fingerholds. (See FIG. 6).

Figure 3:
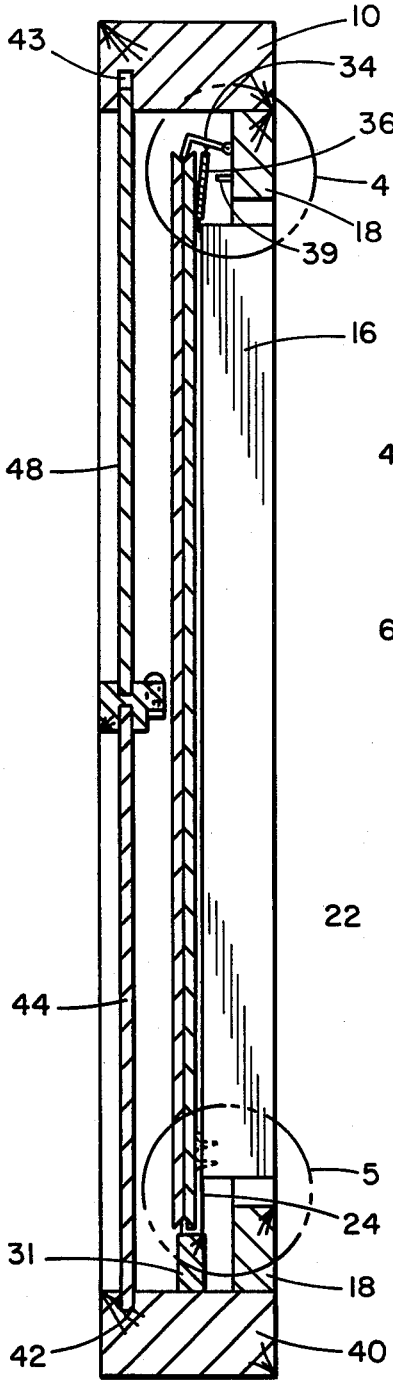
FIG. 3 is a cross-sectional view taken along the line 3—3 of FIG. 2.

As is apparent from FIG. 3, the removal of either the top outer panel 48 or the bottom outer panel 44 will expose the decorative panel 22 to view. Once a wall is modified to include a series of adjacent frame sections, the design possibilities are increased and the appearance of the wall can be changed easily.

Figure 6:
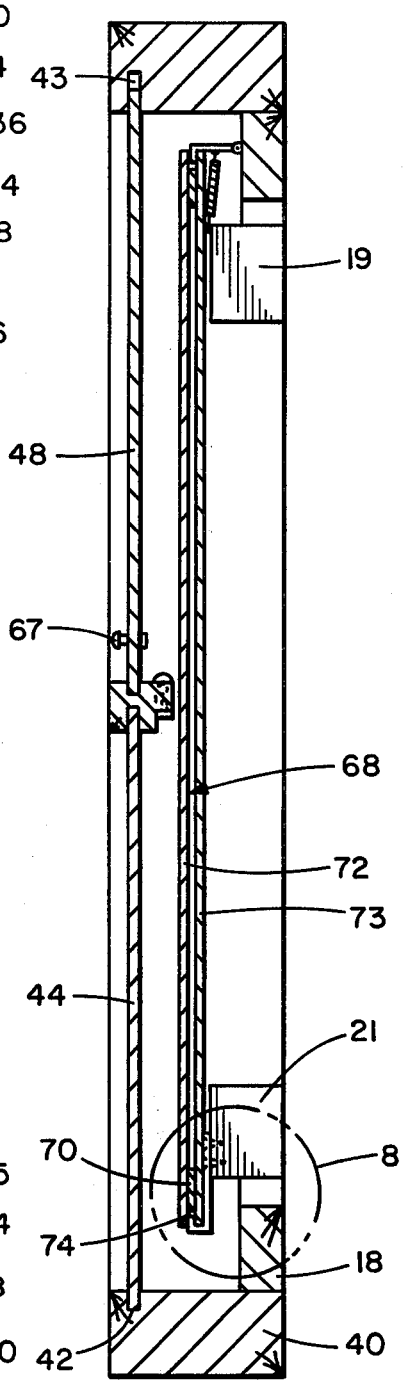
FIG. 6 is a sectional view illustrating an alternative form of inner decorative panel.

FIGS. 6 and 8 illustrate an alternative form of inner decorative panel 68. A spacer strip 70 is inserted along both the top and bottom edges between two panels 72 and 73 to define a recess 74. The flange 32 of the angle bracket 24 engages the recess 74, as previously described for the inner decorative panel 22. Similarly, the latch 34 positioned at the top of the support 20 engages the recess 74 defined by the top edge of the panel 68.

Figure 7:
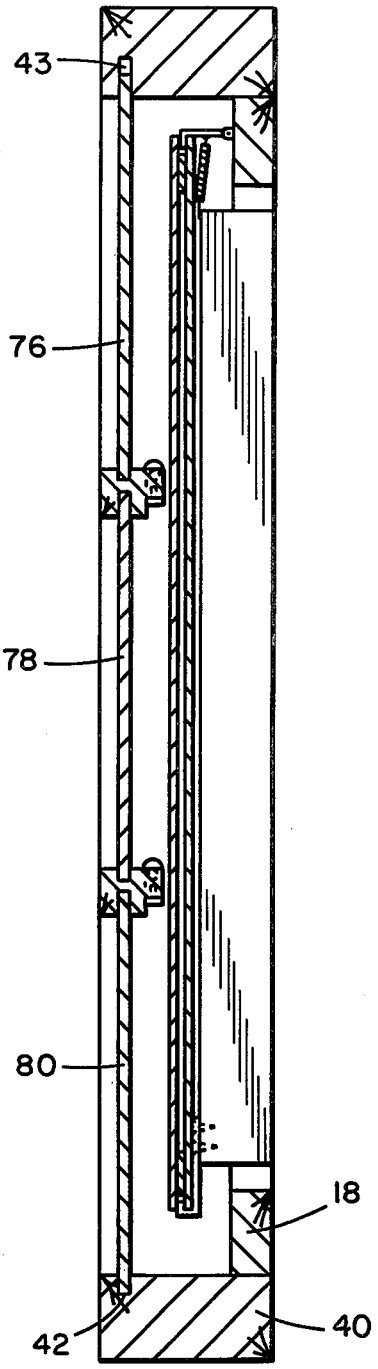
FIG. 7 is a sectional view illustrating an alternative tiered arrangement of outer panels.

FIG. 7 further illustrates the versatility of the invention. Two interchangeable shelves 64 are positioned between the side frame sections 49 to support three outer panels 76, 78 and 80 in a tiered relationship. Each outer panel is supported by a pair of braces 54 which engage holes 50 spaced along adjacent side frame sections and by a shelf 64. It is evident that any number of outer panels can be inserted into the frame by varying the number of shelves.

FIG. 9 shows an additional configuration of the wall display structure. The spacing of two adjacent side frame members 49 defines the width of the panels. In this embodiment, however, each outer panel 82, 84 and 86 is trapezoidal. The angle between the plates 56 and 58 of the brace 54 must be defined to support the shelf 64 and each out4r panel. Braces with angles of 45° and 135° are illustrated; but variations in the conformation of the brace 54 are contemplated. As previously described, the removal of an outer panel exposes the inner decorative panel 22 to view.

It will be understood that other mounting means functioning in the manner described herein could provide suitable alternatives. It will also be understood that changes and modifications may be made in the subject matter described without departing from the spirit of the invention, particularly as described in the following claims.

That which is claimed is:

1. A changeable wall structure comprising a support, a frame secured to said support, an inner panel, a first mounting means connected to said support for removably holding said inner panel, at least one outer panel, and a second mounting means connected to said frame for removably holding said outer panel to conceal said inner panel, said inner and outer panels being removably held so that each panel substantially fills the space between the sides of the frame and, upon removal of an outer panel, the inner panel is exposed to view, said second mounting means comprising a brace secured to each side of the frame and a shelf supported at each end by the brace such that the shelf engages the sides of the frame, the shelf having a groove extending along its upper and lower surfaces for receiving the bottom and top edges, respectively, of said outer panels.

2. A structure in accordance with claim 1 wherein said first mounting means releasably holds said inner panel to permit reversing the panel for display of either side of the panel, and permits removal of the panel for replacement with a different inner panel.

3. A structure in accordance with claim 1 wherein said first mounting means comprises a bracket extending downwardly from said support, and a channel defined at the bottom of said bracket for supporting the lower edge of said inner panel.

4. A structure in accordance with claim 1 wherein the first mounting means further comprises a latch means suspended from said support, the latch means including an engaging end for supporting the upper edge of said inner panel.

5. A structure in accordance with claim 1 wherein said second mounting means releasably holds said outer panels to permit reversing each outer panel for display of either side of the panel, and permits removal of the panel for replacement with a different outer panel.

6. A structure in accordance with claim 1 wherein said second mounting means further comprises a channel extending along the interior surface of the frame for receiving the edges of said outer panels.

7. A structure in accordance with claim 1 comprising a plurality of frame sections in a side-by-side relationship extending over a wall, said inner and outer panels being removably mounted within each frame section.

* * * * *